US009170554B2

(12) United States Patent
Kojima et al.

(10) Patent No.: US 9,170,554 B2
(45) Date of Patent: Oct. 27, 2015

(54) CLEANING DEVICE, PROCESS CARTRIDGE, AND IMAGE FORMING APPARATUS

(71) Applicants: Takeshi Kojima, Yokohama (JP); Hirotaka Hatta, Kawasaki (JP); Toshiya Satoh, Atsugi (JP); Akira Asaoka, Ebina (JP)

(72) Inventors: Takeshi Kojima, Yokohama (JP); Hirotaka Hatta, Kawasaki (JP); Toshiya Satoh, Atsugi (JP); Akira Asaoka, Ebina (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/974,768

(22) Filed: Aug. 23, 2013

(65) Prior Publication Data

US 2014/0093295 A1 Apr. 3, 2014

(30) Foreign Application Priority Data

Oct. 3, 2012 (JP) ..... 2012-221549

(51) Int. Cl.
*G03G 21/10* (2006.01)
*G03G 21/00* (2006.01)

(52) U.S. Cl.
CPC ..... *G03G 21/0011* (2013.01); *G03G 21/007* (2013.01); *G03G 21/0017* (2013.01); *G03G 21/0035* (2013.01)

(58) Field of Classification Search
CPC ..... G03G 21/0029; G03G 21/007; G03G 21/0035
USPC ..... 399/349, 357
See application file for complete search history.

(56) References Cited

U.S. PATENT DOCUMENTS

| | | | | |
|---|---|---|---|---|
| 4,660,962 | A * | 4/1987 | Maekawa et al. | 399/354 |
| 6,539,197 | B2 * | 3/2003 | Waterschoot | 399/353 |
| 6,640,080 | B2 * | 10/2003 | Endo et al. | 399/349 |
| 8,019,268 | B2 * | 9/2011 | Nakamatsu et al. | 399/349 |
| 2006/0039711 | A1 * | 2/2006 | Shibuya et al. | 399/44 |
| 2011/0085834 | A1 * | 4/2011 | Naruse et al. | 399/350 |
| 2012/0114404 | A1 * | 5/2012 | Ichikawa et al. | 399/351 |

FOREIGN PATENT DOCUMENTS

| | | | |
|---|---|---|---|
| JP | 06019380 | A * | 1/1994 |
| JP | 2005-181570 | | 7/2005 |
| JP | 2006-154796 | | 6/2006 |
| JP | 2009-20249 | | 1/2009 |
| JP | 2010-170020 | | 8/2010 |
| JP | 2010-181669 | | 8/2010 |
| JP | 2011-53613 | | 3/2011 |

* cited by examiner

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

A cleaning device includes a brush to contact a photoconductive member, a roller to contact the brush, and a blade. The blade is located along the roller in a longitudinal direction. The blade has a first portion, a second portion, and a bent portion between the first portion and the second portion. A contact surface or edge of the first portion contacts a surface of the roller to remove toner therefrom.

20 Claims, 11 Drawing Sheets

CONVENTIONAL EXAMPLE

CONVENTIONAL EXAMPLE

CONVENTIONAL EXAMPLE

CONVENTIONAL EXAMPLE

CONVENTIONAL EXAMPLE

CLEANING DEVICE, PROCESS CARTRIDGE, AND IMAGE FORMING APPARATUS

CROSS-REFERENCE TO RELATED APPLICATIONS

This patent specification is based on and claims priority from Japanese Patent Application No. 2012-221549, filed on Oct. 3, 2012, in the Japan Patent Office, the content of which is hereby incorporated by reference in its entirety.

BACKGROUND

1. Field of Disclosure

This disclosure generally relates to a cleaning device used in a facsimile machine, a printer, a copier, a multifunction printer or other similar machine, a process cartridge including the cleaning device and an image forming apparatus including the process cartridge.

2. Discussion of the Background Art

An image forming apparatus of an electrophotography type locates a charging device, an optical scanning device, a developing device, a transfer device, a charge removing device, and a cleaning device around a photoconductive drum. The charging device takes a uniformly charge on a surface of the photoconductive drum by a corona discharge. The optical scanning device writes a latent electrostatic image on the surface of the photoconductive drum, and the developing device develops a toner image. After that, an intermediate transfer belt transfers a toner on the photoconductive drum thereon to contact with the toner image on the photoconductive drum and to apply a bias. In addition, a secondary transfer roller transfers the toner on the intermediate transfer belt to a sheet. A fixing device fixes the toner on the sheet with heat to apply the transferred the toner to the sheet. After the transferring, the charge removing device removes a charge and the cleaning device cleans the surface of the photoconductive drum.

After that, the image forming apparatus repeats a next process in accordance with the above.

A conventional cleaning device for an image forming apparatus is shown in FIG. 12.

FIG. 12 shows the cleaning device using a cleaning blade 900. The cleaning device cleans almost all the toner that makes contact with a photoconductive drum 901. Japanese Examined Patent Application Publication No. 2011-053613 and Japanese Examined Patent Application Publication No. 2005-181570 disclose cleaning devices in accordance with FIG. 12.

FIG. 13 shows a cleaning device using cleaning brushes 908 and 906. The charging devices 907 apply a bias to the cleaning brushes 908 and 906 and collection rollers 912. The cleaning brushes 908 and 906 electrically clean toner 903 on the photoconductive drum 901. The collection rollers 912 electrically collect the toner 903 on the cleaning brushes 908 and 906. Collection blades 914 collect the toner 903 on the collection rollers 912. The cleaning brushes 908 and 906 collect more toner than the cleaning blade 900.

Japanese Examined Patent Application Publication No. 2010-170020 and Japanese Examined Patent Application Publication No. 2010-181669 disclose cleaning devices in accordance with FIG. 13.

FIG. 14 shows a cleaning device using the cleaning brush 906 and the cleaning blade 900. The cleaning blade 900 locates a downstream side in a rotation direction of the photoconductive drum 901 with respect to the cleaning brush 906. The cleaning brush 906 removes almost all of the toner 903 and the cleaning blade 900 removes remaining toner. Japanese Patent No. 4597837 discloses a cleaning device in accordance with FIG. 14.

The collection blades 914, discussed above, are made of a thin metal.

As shown in FIG. 15, a collection blade 914', which includes a thin blade 916 welded to a thick blade holder 915, clamps a frame of a cleaning apparatus as shown in FIG. 15.

Japanese Examined Patent Application Publication No. 2011-053613 discloses a collection blade that forms a rectangular shape and is detachable from a blade holder and a metal blade by a screw.

FIG. 16 illustrates a conventional cleaning blade experiencing entrainment.

SUMMARY

In an exemplary implementation, a cleaning device includes a brush to contact a photoconductive member, a roller to contact the brush; and a blade provided along the roller in a longitudinal direction of the roller. The blade can include a first portion including a contact surface to contact a surface of the roller, a second portion, and a bent portion provided between the first portion and the second portion.

The cleaning device can include a spacer to define a contact condition between the blade and the roller. The spacer can have a quadrilateral, rectangular or trapezoidal shaped cross-section.

The spacer can define a contact angle between the blade and the roller. The spacer can be provided between the second portion and a frame of the cleaning device to define the contact angle between the blade and the roller.

A bias can be applied to the brush directly or indirectly. The roller can be a metal roller, and a bias can be applied to the metal roller directly or indirectly. The blade can be a metal blade.

The first portion can be planar and can be provided in a vertical direction in an operational state when the contact surface of the first portion contacts the roller. The cleaning device can further include a toner conveyor to convey toner that is removed by the blade, wherein, in the operational state, the roller can be located above the toner conveyor and between the brush and the toner conveyor, and the second portion can be located above the toner conveyor.

A direction of contacting/separating of the contact surface against the roller can be parallel to a direction of a fixed surface of the second portion.

The contact surface of the first portion can elastically contact the roller.

The first portion can be planar and aligned in a horizontal direction in an operational state when the contact surface contacts the roller.

The first portion can be planar and can be inclined with respect to horizontal in an operational state when the contact surface contacts the roller.

The contact surface of the first portion can contact a lowermost position of the roller in an operational state.

The contact surface of the first portion can contact the roller at a position that is offset in a downstream direction of a lowermost position of the roller in an operational state with respect to a rotating direction of the roller.

The blade can have an L-shaped cross-section.

The blade can have a V-shaped or an arc-shaped cross-section.

The second member can include a plurality of holes to fix the second member and an installation part by fasteners, and the holes can be located along the bent portion.

The cleaning device can further include a cleaning blade located downstream of the brush in a moving direction of the photoconductive member.

A process cartridge can include the cleaning device and the photoconductive member, wherein the photoconductive member and the cleaning device are detachable as a unit from a body of an image forming apparatus. An image forming apparatus can include the process cartridge, wherein the photoconductive member and the cleaning device are detachable as a unit from a body of the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY IMPLEMENTATIONS

Figure 1:
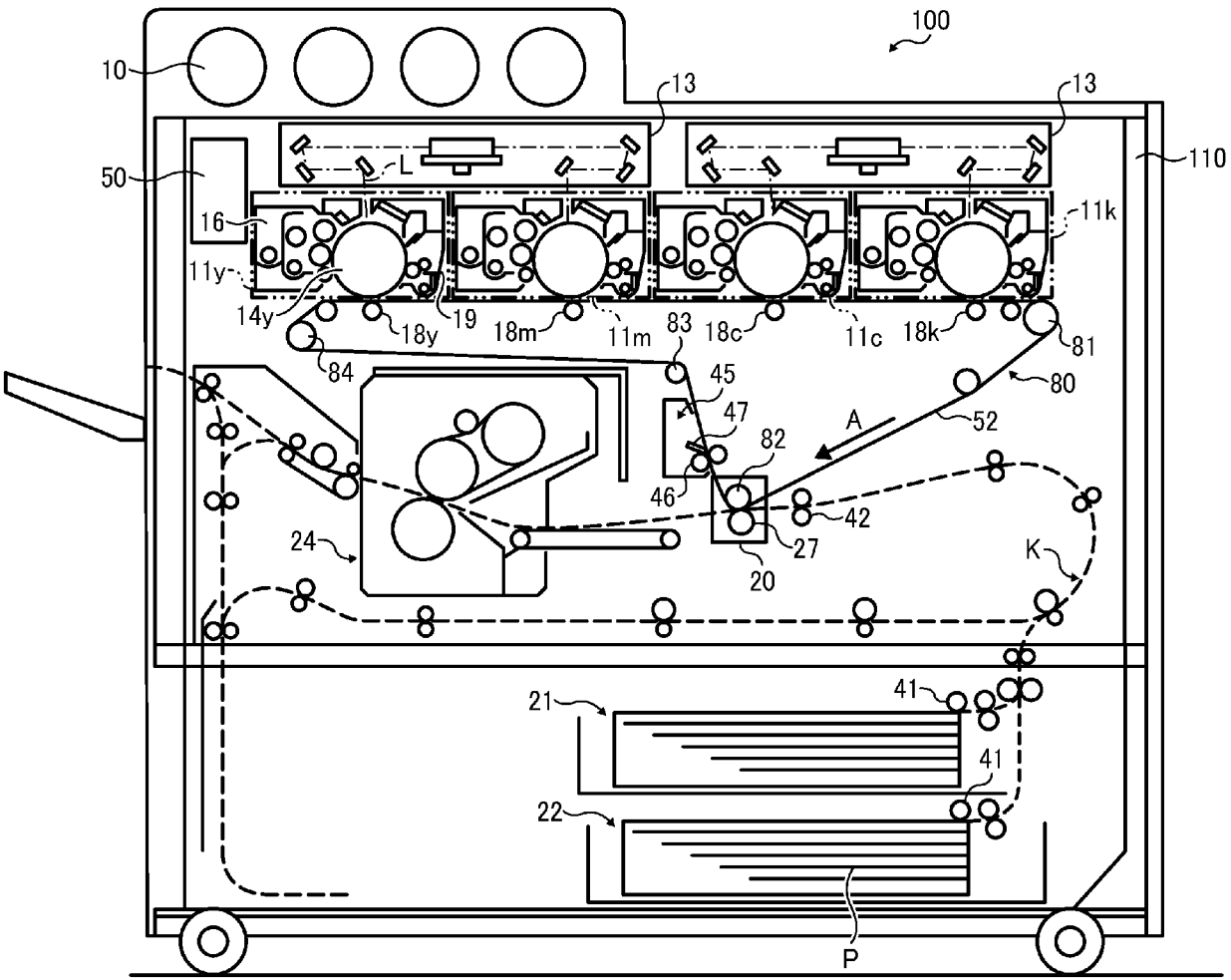
FIG. 1 is a schematic view of a printer including a cleaning device.

In describing the implementations illustrated in the drawings, specific terminology is employed for the sake of clarity. However, this disclosure is not intended to be limited to the specific terminology so selected, and it is to be understood that each specific element includes all technical equivalents that operate in a similar manner and achieve a similar result.

The same members as in each configuration are attached with the same reference numbers. In addition, explanations for the same effects as in exemplary implementations 1 through 4 may be omitted.

FIG. 1 shows an image forming apparatus using a cleaning device according to an exemplary implementation of this disclosure.

Toner containers 10 contain toner and are located at an upper portion of a printer 100.

An intermediate transfer unit 80 is located at a nearly center of the printer 100 (as an image forming apparatus).

The intermediate transfer unit 80 includes an intermediate transfer belt 52 as an intermediate transfer member that forms a loop shape, and a plurality of support rollers to stretch the intermediate transfer belt 52.

The support rollers include a driving roller 81 to drive and rotate the intermediate transfer belt 52 in a clockwise direction, a secondary transfer backup roller 82, driven rollers 83 and 84, and primary transfer rollers 18*y*, 18*c*, 18*m*, and 18*k*.

Here, "y, c, m, and k," stand for yellow, cyan, magenta, and black, respectively, to clarify for which of the colors a part is used.

The intermediate transfer belt 52 stretches and forms an inverted triangle. Process cartridges 11*y*, 11*c*, 11*m*, and 11*k* are located on a horizontal surface of the intermediate transfer belt 52.

Figure 2:
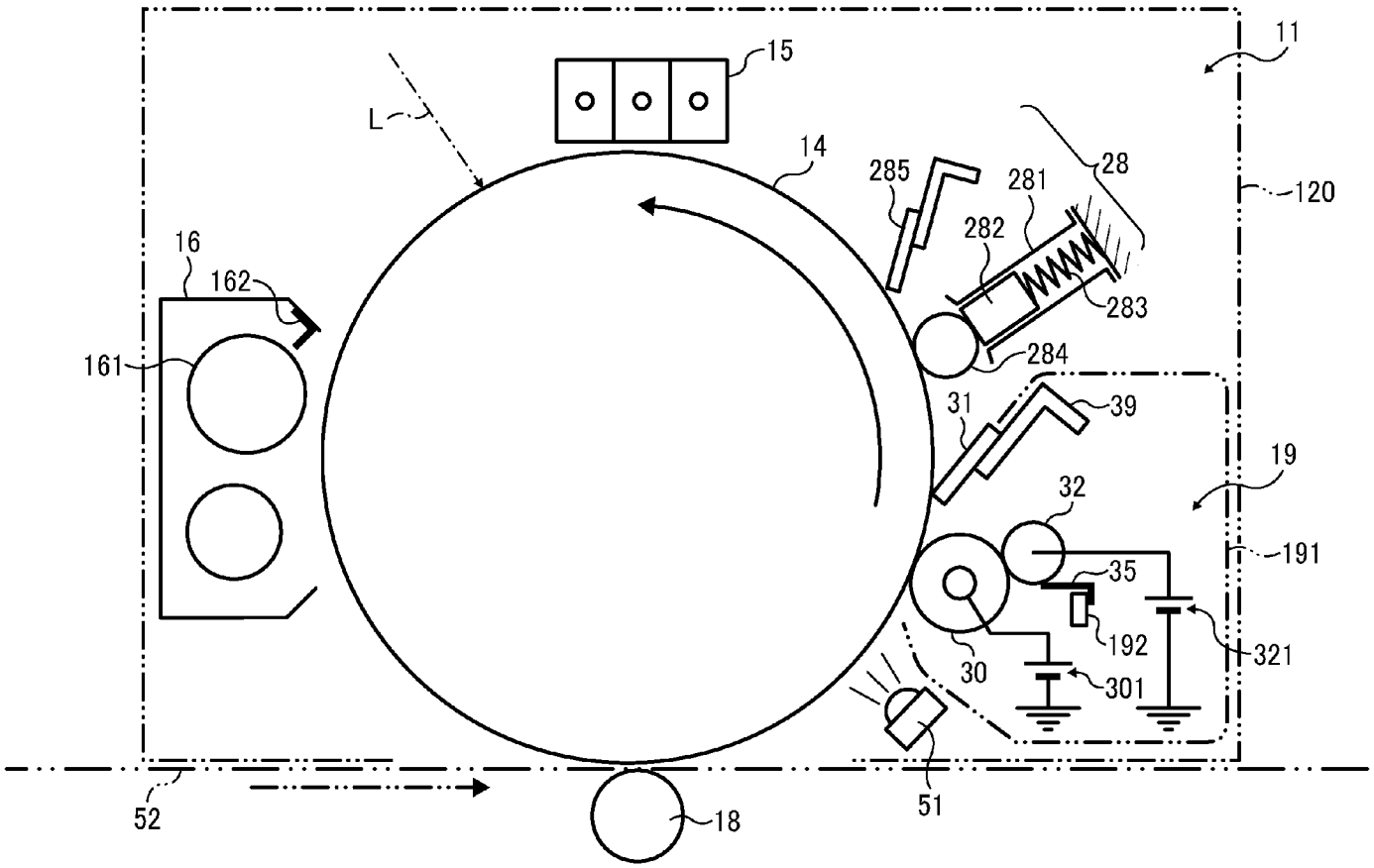
FIG. 2 is a schematic view of a process cartridge of the printer.

The process cartridge 11 accommodates at least a photoconductive drum 14, a cleaning device 19, a charge device 15, and a developing device 16, as shown in FIG. 2.

The photoconductive drum 14 rotates in a counterclockwise direction. The charge device 15 takes a uniform charge on a surface of the photoconductive drum 14. The charged surface of the photoconductive drum 14 reaches an irradiation position of an optical scanning light L by an optical scanning device 13, and forms a latent electrostatic image based on image information.

As shown in FIG. 1, the optical scanning devices 13 irradiate the optical scanning light L based on image information for the photoconductive drums 14*y*, 14*m*, 14*c*, 14*k*, and are located over the process cartridges 11*y*, 11*c*, 11*m*, and 11*k*.

The optical scanning devices 13 receive color data based image data of a manuscript that a scanner 500 (FIG. 10) provides or that a computer sends to a controller 50, and irradiate four optical scanning lights to drive four semiconductor lasers.

After that, the optical scanning devices 13 write each latent electrostatic image for each color on the surface of the photoconductive drums 14*y*, 14*c*, 14*m*, and 14*k*.

Each latent electrostatic image of the photoconductive drums reaches to face the developing device 16, and is developed by the developing device 16. A toner of the developing device 16 moves to a developing roller 161, passes a doctor blade 162 (FIG. 2), and reaches and adheres to the latent electrostatic image on the photoconductive drum 14.

After developing, the surface of the photoconductive drum 14 reaches a primary transfer position where the primary transfer roller 18 faces the photoconductive drum 14.

The intermediate transfer belt 52 transfers each color toner image on the photoconductive drums 14 at a primary transfer position.

After that, the intermediate transfer belt 52 transfer each toner image as a full color toner image to a secondary transfer portion 20.

The secondary transfer portion 20 includes the secondary transfer backup roller 82 and a secondary transfer roller 27, and transfers the full color toner image on a sheet that is fed from sheet feeders 21 and 22.

A fixing device 24 fixes the toner on the sheet downstream of the secondary transfer portion 20.

Moreover, after passing the secondary transfer portion 20, the intermediate transfer belt 52 reaches the belt cleaning portion 45. The belt cleaning portion 45 includes a guide roller 46 and a removable blade 47 to remove remaining toner(s).

FIG. 2 shows a schematic view of the process cartridge 11.

The casing 120, as a frame of the process cartridge 11, supports the photoconductive drum 14, the cleaning device 19, the charge device 15, the developing device 16, a charge removing device 51, and a lubricant applying device 80. The casing 120 is detachable as a unit from a body 110 of the printer 100. Therefore, the process cartridge 11 improves a maintenance performance.

All the four process cartridges 11*y*, 11*c*, 11*m*, and 11*k* have the same configuration except for the color of toner by the toner container 10.

Meanwhile, after primary transferring, as mentioned above, an untransferred toner remains on the surface of the photoconductive drum 14, which the intermediate transfer belt 52 does not transfer from the photoconductive drum 14. The charge removing device 51 removes a residual electrostatic potential on the surface of the photoconductive drum 14. After removing the residual electrostatic potential, the surface of the photoconductive drum 14 having the untransferred toner reaches the cleaning device 19.

As shown in FIG. 2, the cleaning case 191 of the cleaning device 19 includes the cleaning brush 30 and cleaning blade 31. The cleaning brush 30 that takes a positive charge contacts the photoconductive drum 14 and removes the untransferred toner electrostatically and mechanically. An unremovable toner that is not removed by the cleaning brush 30 reaches the cleaning blade 31.

The cleaning blade 31 is an elastic member that is made of polyurethane rubber, the cleaning blade 31 forms rectangular shapes of cross-section and configuration.

The cleaning case 191 of the casing 120 engages the cleaning blade 31 via a support bracket. The cleaning blade 31 removes the unremovable toner.

Figure 3:
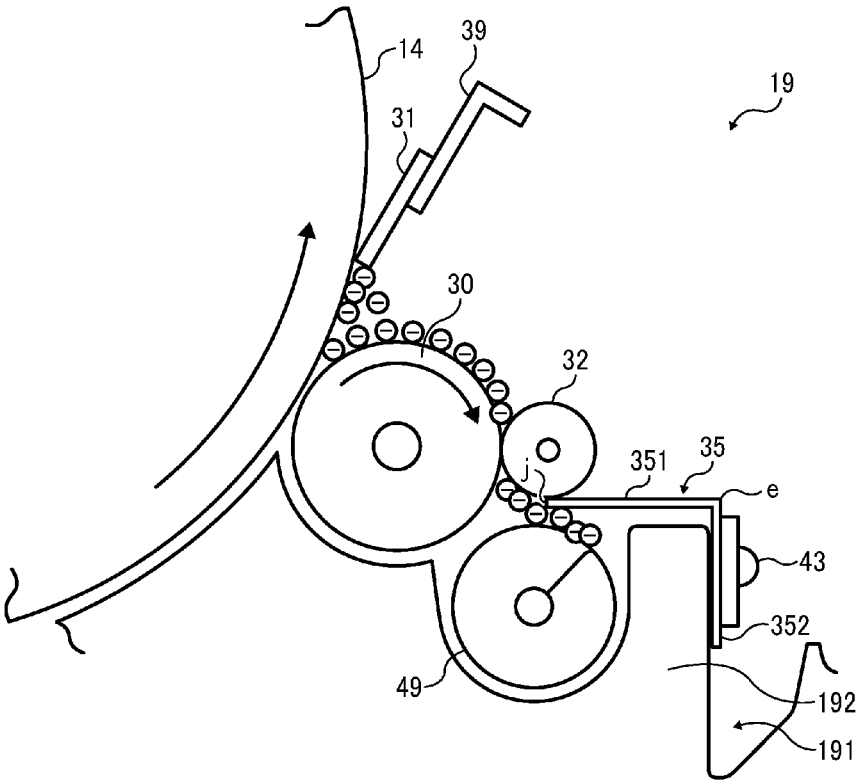
FIG. 3 is an enlarged view of a cleaning device mounted to the process cartridge in FIG. 2.

As shown in FIG. 3, the toner removed by the cleaning device 19 and the cleaning blade 31 moves to a waste toner container via a conveyance screw 49.

As shown in FIG. 2, after removing the unremovable toner by the cleaning device 19, a lubricant applying device 28 applies a wax 282 (Zinc stearate) to the photoconductive drum 14 to protect the surface of the photoconductive drum 14.

The lubricant applying device 28 includes a casing 281 having the wax 282, a spring 283 to bias the wax, and a rotatable brush 284 to scrape the wax and to apply the wax to the surface of the photoconductive drum 14.

Figure 16:
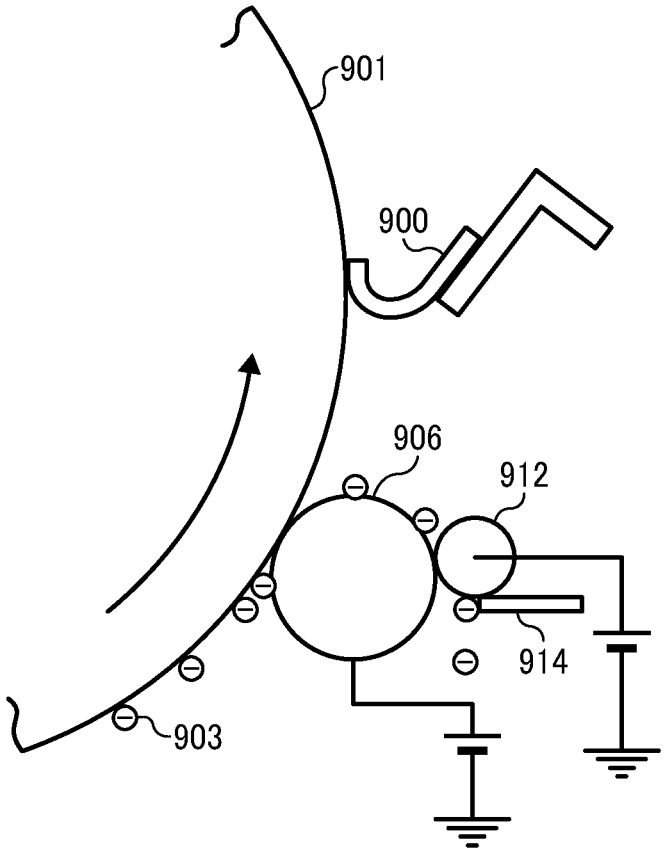
FIG. 16 illustrates a conventional cleaning blade experiencing entrainment.

An applying blade 285 locates a downstream side of the rotatable brush 284 in the rotating direction of the photoconductive drum 14, and adjusts a thickness of the applying wax. Therefore, the cleaning blade is prevented from an entrainment, as shown in FIG. 16.

Next, a detailed configuration of the cleaning device 19 in accordance with a first exemplary implementation is shown in FIG. 3.

The cleaning device 19 includes the cleaning brush 30, a metal roller 32 as a collection roller to remove the toner on the cleaning brush 30, a metal blade 35 as a collection blade to remove the toner on the metal roller 32, and the conveyance screw 49.

The cleaning brush 30 drives to rotate in a clockwise direction, and electrically removes the toner on the photoconductive drum to adhere the toner thereon.

The metal roller 32 contacts the cleaning brush 30, and electrically removes the toner on the cleaning brush 30 to adhere the toner thereon.

An edge j of the metal blade 35 elastically contacts a surface of the metal roller 32 and mechanically removes the toner of the metal roller 32.

The cleaning brush 30 has the following characteristics. A material of a bristle of the brush 30 is conductive polyester. A diameter of the bristle is 14 mm. A length of the bristle is 4 mm. A Biting amount of the brush against the photoconductive drum 14 is 1 mm. A Velocity of the brush in a state that the photoconductive drum 14 contacts is 205 mm/s. Applied voltage by the charge device 301 is 800 V. A warp resistance is 108 ohm/cm. A bristle density is 100,000 bristles per square inch.

The metal roller 32 has the following characteristics. A material is stainless steel (S11). A diameter is 12 mm. A Velocity of the metal roller is 205 mm/s. Applied voltage by the charge device 321 is 1200 V. The metal blade 35 is located under surface of the metal roller 32 and faces the cleaning brush 30.

Figure 4:
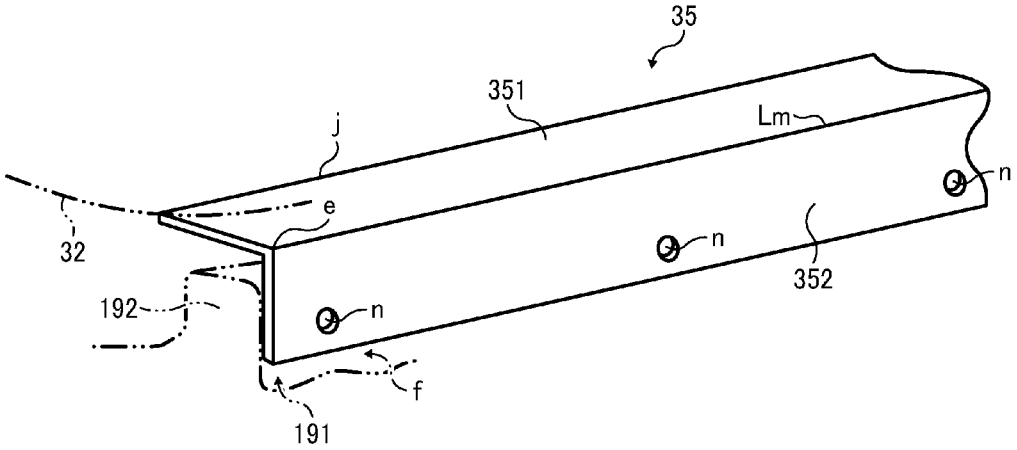
FIG. 4 is a cutaway, perspective view of a metal blade using the cleaning device in FIG. 3.

The metal blade 35 is made of a 0.3 mm thick stainless steel (S11S), and bends as shown in FIG. 4. The thickness of the metal blade 35 may be 0.1-0.6 mm.

The metal blade 35 faces and is located along the longitudinal direction of the metal roller 32. The metal blade 35 fastens on an installation part 192 of a side of a cleaning case 191 of the cleaning device 19.

The metal blade 35 bends in an L-shape as shown in FIGS. 3 and 4. A cross-sectional shape of the blade 35 forms a same shape in the direction perpendicular to a cross-section of the blade 35. An edge side portion 351 forms a side of a bent portion "e", and an installation side portion 352 forms the other side of the bent portion "e".

The installation side portion 352 overlaps and fastens on the fixed surface "f" of the installation part 192 to insert screws 43 with holes "n".

In a state where the metal blade 35 fastens the installation part 192, the edge side portion 351 contacts equally in the longitudinal direction with the surface of the metal roller 32. Moreover, the metal blade 35 elastically contacts a surface of the metal roller 32 as shown by arrow a1 in FIG. 5A. Therefore, it prevents a gap between an edge of the edge side portion 351 and the metal roller 32.

The metal blade 35 is made of metal in consideration of a long-life and to provide high accuracy contact with the metal roller 32.

If a gap occurs between the metal blade 35 and the metal roller 32, toner can pass between the metal blade 35 and the metal roller 32, and remain on the metal roller 32. After that, the toner can return and adhere to the cleaning brush 30. As discussed above, the metal blade 35 prevents the gap from occurring.

Originally, the metal blade 35 is desirable such that the edge side portion 351 forms a thin shape and is easy to displace elastically. The installation side portion 352 is desirable to be thick so as to prevent deformation of the edge of the edge side portion 351 according to the screw force of the screws.

Alternatively, the metal blade 35 of the present implementation includes both desirable features, as mentioned above, according to bending to provide the L-shape shown in FIG. 4, despite the edge side portion 351 and the installation side portion 352 having a same thickness. Moreover, in a case where the installation side portion 352 deforms according to the screw force of the screws 43, a ridgeline "Lm" of the bent portion "e" regulates the deformation to the edge side portion 351. Therefore, it is able to maintain an accuracy of position of the edge side portion 351 against the metal roller 32.

Moreover, the metal blade 35 having the L-shape has higher rigidity than that of rectangular shapes, and provides improved accuracy of position of the edge side portion 351 against the surface of the metal roller 32. Thus, in an initial state where the edge side portion 351 contacts the surface of the metal roller 32, stability is maintained in the long-term.

Moreover, as shown in FIG. 5, the direction "a1" of contacting/separating of the edge side portion 351 against the metal roller 32 is parallel to the direction "a2" of the fixed surface "f" of the installation part 192. Thus, it is easy to adjust the state where the edge side portion 351 contacts the surface of the metal roller 32.

Figure 5A:
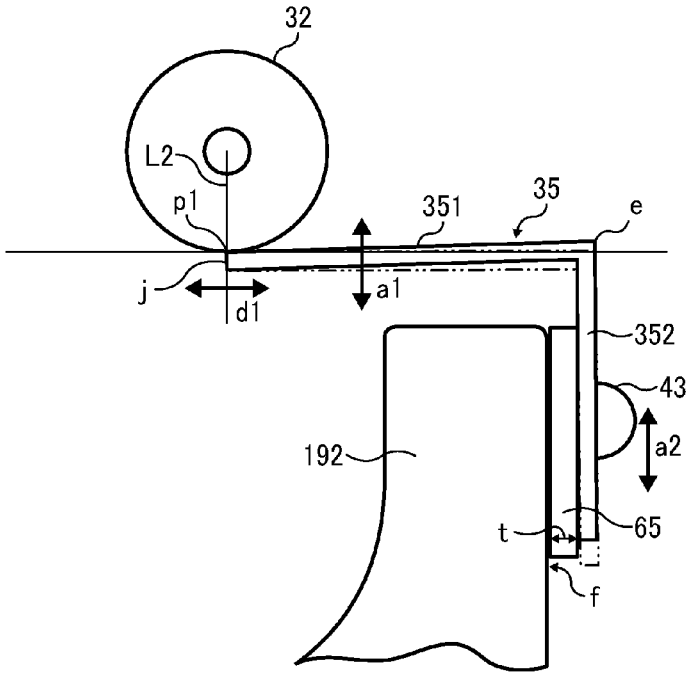
FIG. 5A is an enlarged view of a first installation of the metal blade using the cleaning device in FIG. 3.

Furthermore, a spacer 65, that adjusts a contact condition with the metal blade 35 and the metal roller 32, may be located between the fixed surface "f" of the installation part 192 and the installation side portion 352 as shown in FIG. 5A. The spacer 65 forms a rectangular shape of cross-section. Thus, it is easy to change a horizontal contact location "d1" of the edge of the edge side portion 351 and the surface of the metal roller 32 according to a thickness "t" of the spacer 65.

As shown in FIG. 5A, the edge "j" of the edge side portion 351 elastically contacts a point "p1" on a line "L2" in a radial perpendicular direction of the metal roller 32. A two-dot chain line shows the state where the edge side portion 351 is not elastically deformed.

According to the elastic contact, when the edge "j" of the edge side portion 351 suffers abrasions with time, the edge side portion 351 is elastically deformed to absorb the abrasions and continuously contact the surface of the metal roller 32. Thus, it is stable to remove the toner of metal roller 32.

Figure 5B:
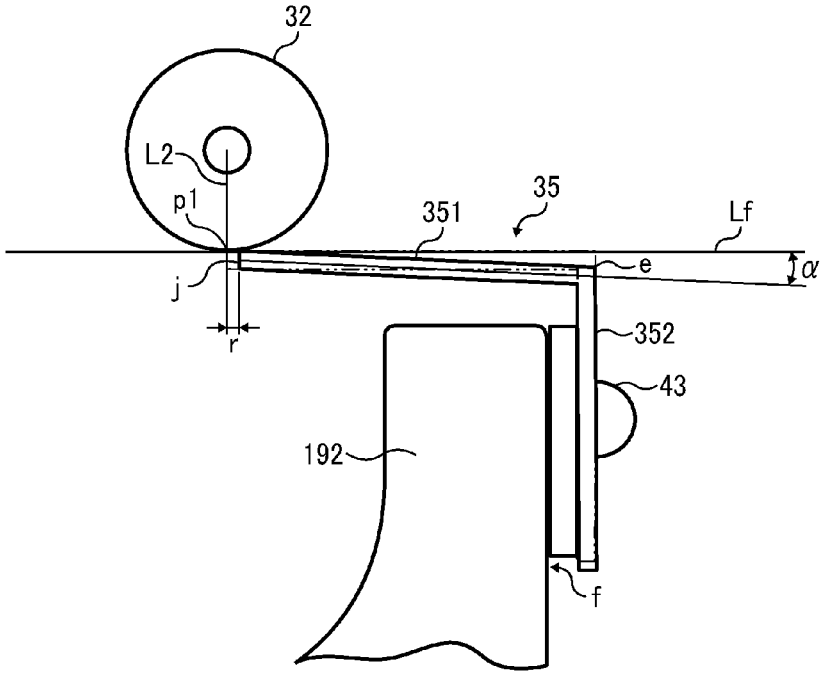
FIG. 5B is an enlarged view of a second installation of the metal blade using the cleaning device in FIG. 3.

As shown in FIG. 5B, when the edge "j" of the edge side portion 351 contacts the surface of the metal roller 32, a tangent "Lf" in perpendicular of the line "L2" and the edge side portion 351 may contact the metal roller 32 at an angle (an angle "alpha"). Thus, the edge "j" of the edge side portion 351 is prevented from separating from the surface of the metal roller 32 according to misregistration in a horizontal direction, which improves the removal of the toner on the metal roller 32.

Moreover, the edge "j" of the edge side portion 351 contacts the metal roller 32 at an offset "r" in a downstream side of a point "p1" with respect to the rotating direction of the metal roller 32 as a two-dot chain line in FIG. 5B. The edge "j" of the edge side portion 351 is prevented from separating from the surface of the metal roller 32. Thus, it improves the removal of the toner on the metal roller 32.

Figure 6:
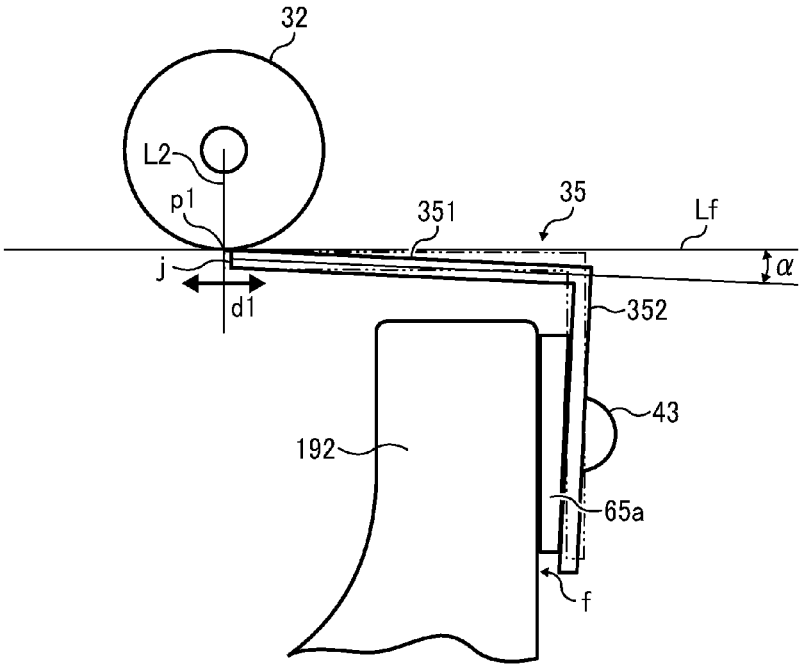
FIG. 6 is an enlarged view of a third installation of the metal blade using the cleaning device in FIG. 3.

The spacer 65 may form a trapezium shape of cross-section as the spacer 65 in FIG. 6. It is easy to adjust the angle "alpha" according to a kind of shape of the metal blade 35.

Figure 7:
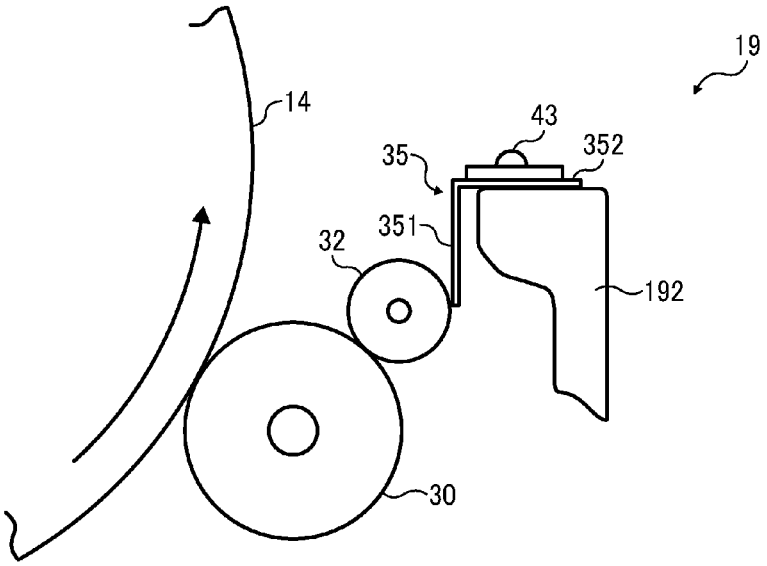
FIG. 7 is an enlarged view of another implementation of the cleaning device mounted to the process cartridge in FIG. 2.

An implementation in FIGS. 4-6 may apply the cleaning device 19 without the cleaning blade as shown in FIG. 7.

In FIG. 7, the cleaning device 19 is mounted on a printer that is desirable for simple functions and is satisfied with an effect of only the cleaning brush 30.

Figure 8:
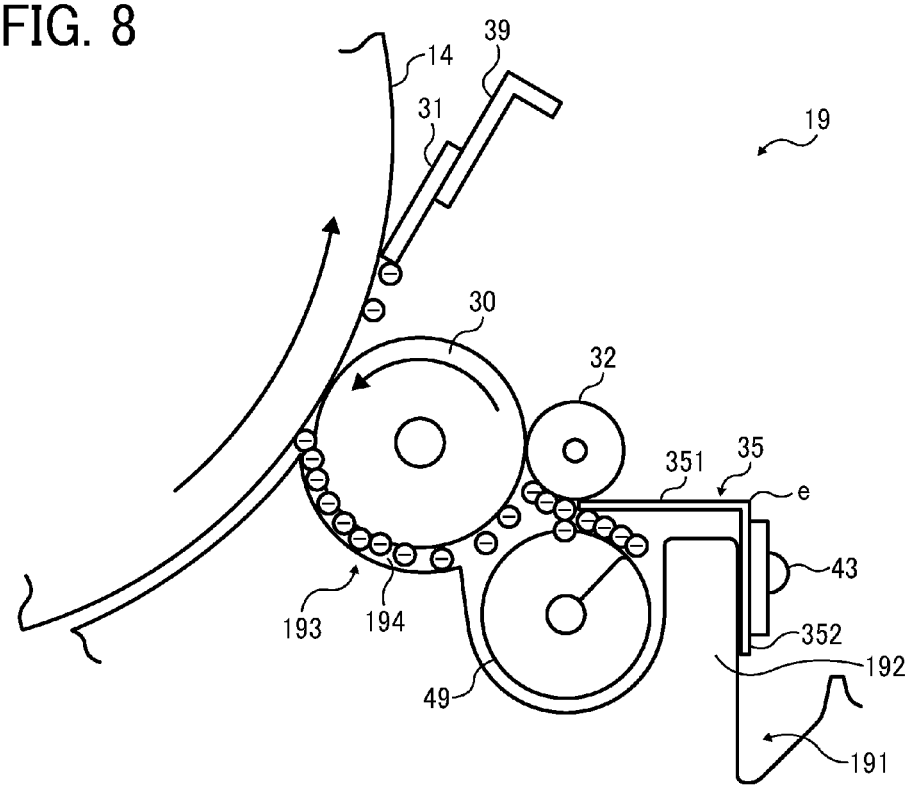
FIG. 8 is an enlarged view of a cleaning device mounted to the process cartridge in FIG. 2.

An implementation in FIGS. 4-6 may apply the cleaning device 19 as another implementation that includes the cleaning brush 30 rotated in counterclockwise, as shown in FIG. 8. The cleaning device 19 can remove toner from the photoconductive drum 14 that passes a clearance portion 194 that is formed between a recess 193 and the cleaning brush 30, and that reaches the metal roller 32 and the metal blade 35.

This prevents toner from scattering by reducing a toner transport distance, and provides an easy implementation to transport the toner to a conveyance screw 49.

Figure 9:
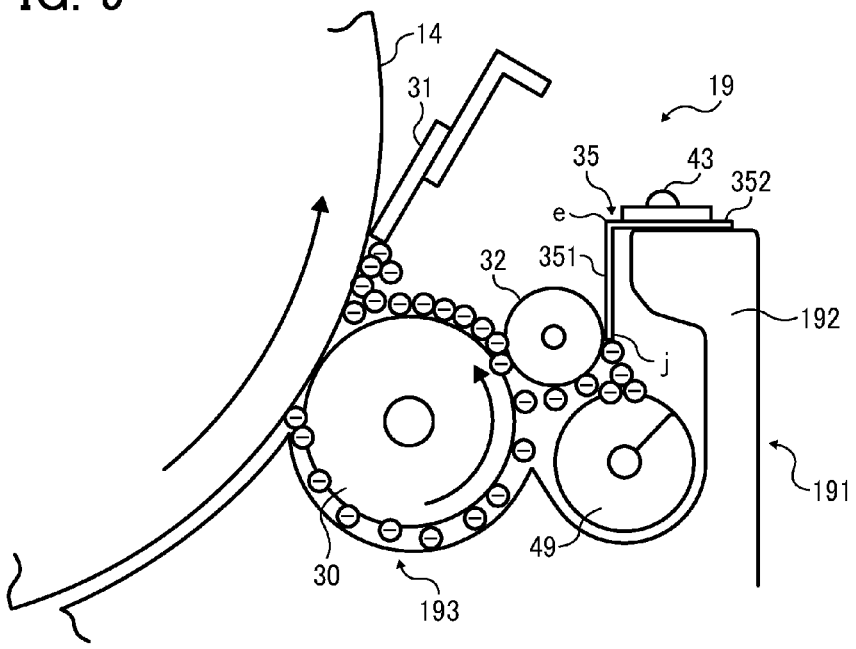
FIG. 9 is an enlarged view of a cleaning device mounted to the process cartridge in FIG. 2.

The cleaning device in FIG. 9 is different with respect to a layout among the cleaning brush 30, a conveyance screw 49, the metal roller 32 and the metal blade 35 in FIGS. 3 and 8. The installation side portion 352 is located above the conveyance screw 49. The metal roller 32 is located between the cleaning brush 30 and a conveyance screw 49. The edge side portion 351 is located in a vertical direction. Therefore, the cleaning device 19 is able to be reduced in size with respect to the width direction.

Figure 10:
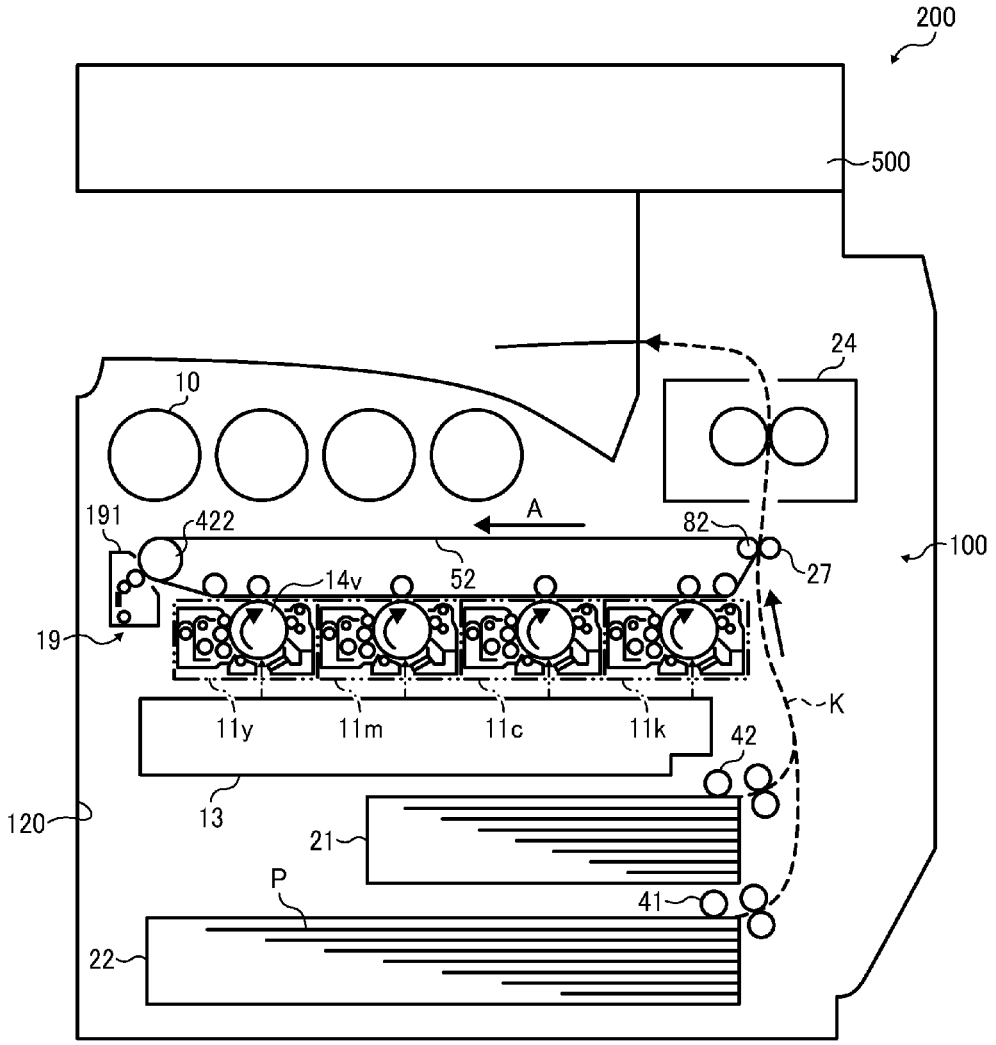
FIG. 10 is a schematic view of a copy machine.
Figure 11:
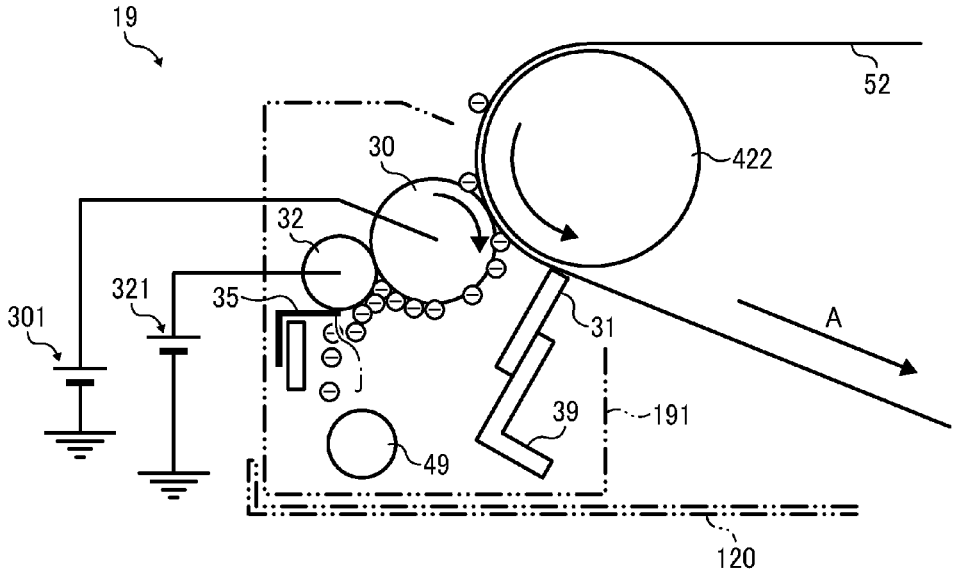
FIG. 11 is an enlarged view of a cleaning device mounted the copy machine in FIG. 10.
Figure 12:
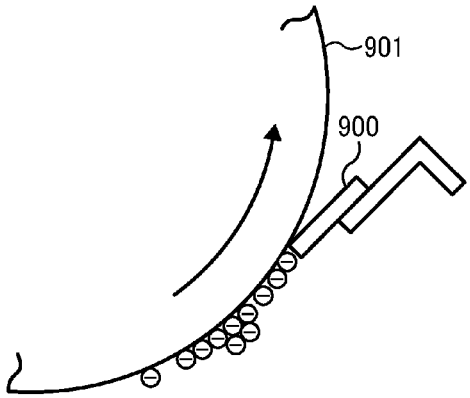
FIG. 12 is a cutaway, perspective view of a conventional cleaning device including a cleaning blade.
Figure 13:
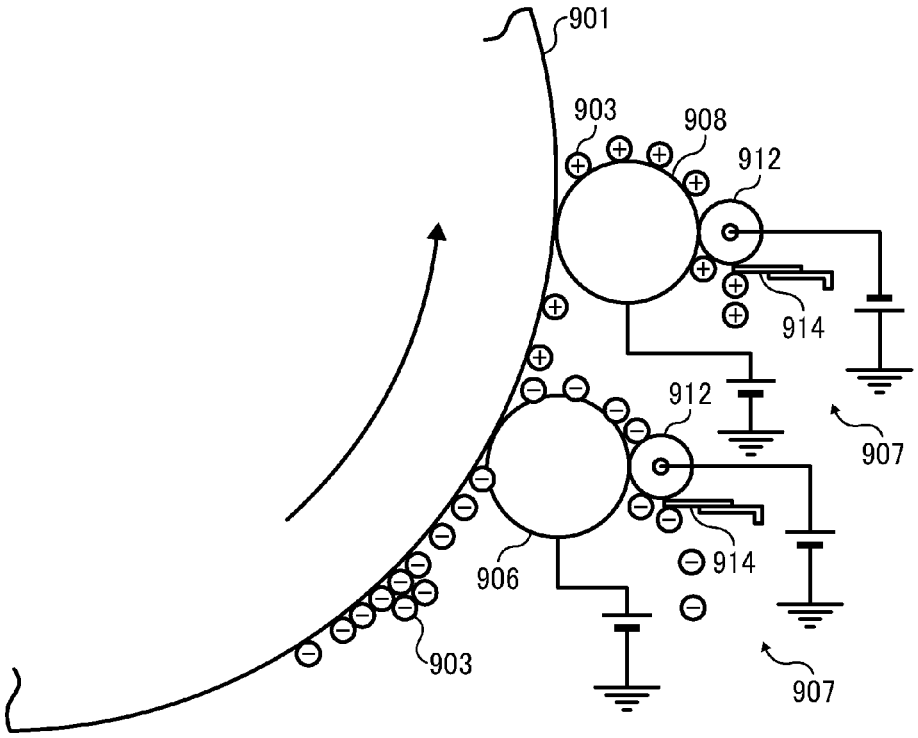
FIG. 13 is a cutaway, perspective view of a conventional cleaning device including two cleaning brushes.
Figure 14:
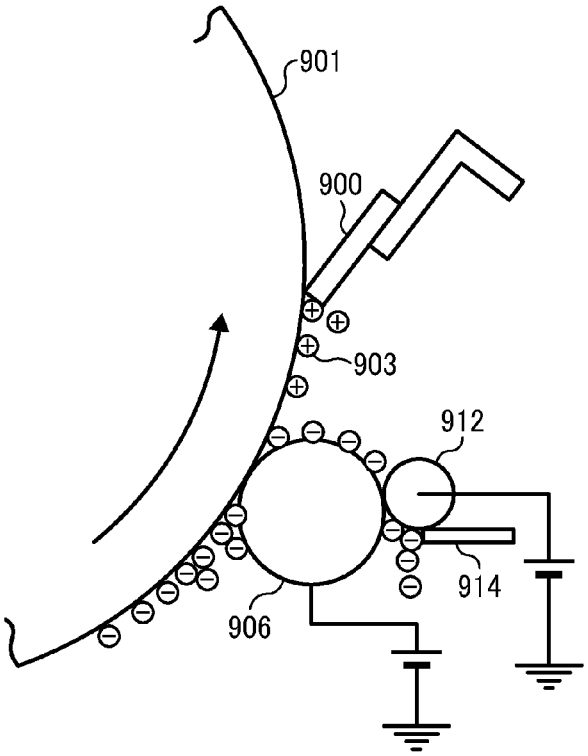
FIG. 14 is a cutaway, perspective view of a conventional cleaning device including a cleaning brush and cleaning blade.
Figure 15:
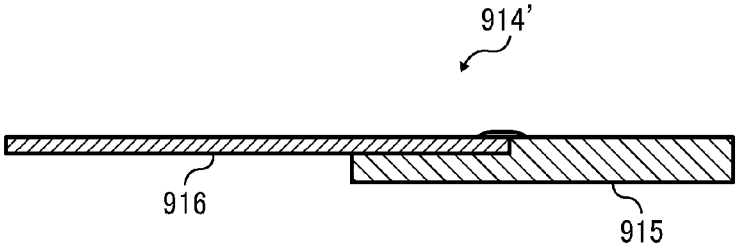
FIG. 15 is a cross-sectional view of a conventional collection blade.

Moreover, an implementation in accordance with FIGS. 3-9 may be applied to the cleaning device 19 to remove toner on the intermediate transfer belt 52, as shown in FIGS. 10 and 11.

FIG. 10 shows a copy machine 200 including a scanner 500 located above the printer 100. The printer in FIG. 10 is different with respect to a layout among the cleaning device 19, the intermediate transfer belt 52 and an optical scanning device 13 in FIG. 1. Moreover, the cleaning device 19 in FIGS. 10 and 11 faces a support roller 422 via the intermediate transfer belt 52.

The metal blade 35 in FIG. 11 is a same configuration the metal blade 35 in FIGS. 3 and 4, and is fastened to the installation part 192.

The cleaning brush 30 electrically removes the untransferred toner on the surface of the intermediate transfer belt 52, rotates in a clockwise direction, and causes the toner to adhere thereon.

The cleaning device 19 is detachable as a unit via the casing 120 of the copy machine 200. Therefore, the cleaning device 19 improves a maintenance performance.

The metal blade bends in the L-shape between the edge side portion and the installation side portion, as mentioned above, however the metal blade may have a V-shape or an arc-shape. A V-shape or an arc-shape of the metal blade has a same effect as the L-shape.

The cleaning device 19 mounts to the printer 100 or copy machine 200, as mentioned above. However, the cleaning device 19 may mount to other image forming apparatuses or multifunction machines. It has the same effect as the cleaning device or the image forming apparatus in FIG. 1.

What is claimed is:

1. A cleaning device comprising:

a brush to contact a photoconductive member;

a roller to contact the brush;

a blade provided along the roller in a longitudinal direction of the roller, the blade including a first portion including a contact surface to contact a surface of the roller, a second portion, and a bent portion provided between the first portion and the second portion; and a toner conveyor to convey toner that is removed by the blade, wherein the first portion, the second portion, and the bent portion are a unitary structure, wherein the first portion is planar and is provided in a vertical direction in an operational state when the contact surface of the first portion contacts the roller, wherein, in the operational state, the roller is located above the toner conveyor and between the brush and the toner conveyor, wherein the second portion is located above the toner conveyor, and wherein a contact point where the blade contacts the roller is between a center of the roller and a center of the toner conveyor.

2. The cleaning device according to claim 1, further comprising:

a spacer to define a contact condition between the blade and the roller.

3. The cleaning device according to claim 1, further comprising a spacer to define a contact angle between the blade and the roller.

4. The cleaning device according to claim 1, wherein:
a bias is applied to the brush directly or indirectly;
the roller is a metal roller, and a bias is applied to the metal roller directly or indirectly; and
the blade is a metal blade.

5. The cleaning device according to claim 1, wherein a direction of contacting/separating of the contact surface against the roller is parallel to a direction of a fixed surface of the second portion.

6. The cleaning device according to claim 1, wherein the contact surface of the first portion elastically contacts the roller.

7. The cleaning device according to claim 1, wherein the first portion is planar and aligned in a horizontal direction in an operational state when the contact surface contacts the roller.

8. The cleaning device according to claim 1, wherein the first portion is planar and is inclined with respect to horizontal in an operational state when the contact surface contacts the roller.

9. The cleaning device according to claim 1, wherein the contact surface of the first portion contacts a lowermost position of the roller in an operational state.

10. The cleaning device according to claim 1, wherein the contact surface of the first portion contacts the roller at a position that is offset in a downstream direction of a lowermost position of the roller in an operational state with respect to a rotating direction of the roller.

11. The cleaning device according to claim 1, wherein the blade has an L-shaped cross-section.

12. The cleaning device according to claim 1, wherein the blade has a V-shaped or an arc-shaped cross-section.

13. The cleaning device according to claim 1, wherein the second portion includes a plurality of holes to fix the second member and an installation part by fasteners, and the holes are located along the bent portion.

14. The cleaning device according to claim 1, wherein the bent portion regulates a deformation to the first portion.

15. The cleaning device according to claim 1, wherein a second portion of the blade is located directly above the toner conveyer.

16. A process cartridge comprising:
the cleaning device according to claim 1; and
the photoconductive member,
wherein the photoconductive member and the cleaning device are detachable as a unit from a body of an image forming apparatus.

17. An image forming apparatus comprising:
the process cartridge according to claim 16,
wherein the photoconductive member and the cleaning device are detachable as a unit from a body of the image forming apparatus.

18. A cleaning device comprising:
a brush to contact a photoconductive member;
a roller to contact the brush; and
a blade provided along the roller in a longitudinal direction of the roller, the blade including a first portion including a contact surface to contact a surface of the roller, a second portion, and a bent portion provided between the first portion and the second portion,
a toner conveyor to convey toner that is removed by the blade,
wherein the first portion and the second portion have a same thickness,
wherein the first portion is planar and is provided in a vertical direction in an operational state when the contact surface of the first portion contacts the roller,
wherein, in the operational state, the roller is located above the toner conveyor and between the brush and the toner conveyor,
the second portion is located above the toner conveyor, and
wherein a contact point where the blade contacts the roller is between a center of the roller and a center of the toner conveyor.

19. A process cartridge comprising:
the cleaning device according to claim 18; and
the photoconductive member,
wherein the photoconductive member and the cleaning device are detachable as a unit from a body of an image forming apparatus.

20. An image forming apparatus comprising:
the process cartridge according to claim 19,
wherein the photoconductive member and the cleaning device are detachable as a unit from a body of the image forming apparatus.

* * * * *